US007450145B2

(12) United States Patent
Yamazaki

(10) Patent No.: US 7,450,145 B2
(45) Date of Patent: Nov. 11, 2008

(54) LIGHT BEAM SCANNER

(75) Inventor: Katsuyuki Yamazaki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 921 days.

(21) Appl. No.: 10/885,667

(22) Filed: Jul. 8, 2004

(65) Prior Publication Data

US 2005/0024480 A1 Feb. 3, 2005

(30) Foreign Application Priority Data

Jul. 14, 2003 (JP) ..... 2003-196347
Jun. 28, 2004 (JP) ..... 2004-189911

(51) Int. Cl.
*B41J 2/44* (2006.01)
*G03G 15/04* (2006.01)

(52) U.S. Cl. ..... 347/261

(58) Field of Classification Search ..... 347/261
See application file for complete search history.

(56) References Cited

U.S. PATENT DOCUMENTS 5,808,431 A 9/1998 Koyama et al. ..... 318/278
5,821,977 A * 10/1998 Nishimura ..... 347/234
2002/0005889 A1* 1/2002 Kishida ..... 347/235

FOREIGN PATENT DOCUMENTS

JP 9-183251 7/1997
JP 11218697 A * 8/1999

* cited by examiner

*Primary Examiner*—Huan H Tran
(74) *Attorney, Agent, or Firm*—Fitzpatrick, Cella, Harper & Scinto

(57) ABSTRACT

A light beam scanner switches between a first mode in which a laser is turned ON to emit a light beam every surface period of a rotary polygon to detect the light beam, and a second mode in which the laser is turned ON to emit the light beam with a long period specified with an integral multiple of two or more of the surface period of the rotary polygon to detect the light beam, for formation of an image and non-formation of an image, thereby improving a life of the laser.

9 Claims, 5 Drawing Sheets

| CONTROL COMMAND | /ACC | /DEC |
|---|---|---|
| ROTATION HOLD COMMAND | H | H |
| ACCELERATION COMMAND | L | H |
| DECELERATION COMMAND | H | L |
| ROTATION HOLD COMMAND | L | L |

LIGHT BEAM SCANNER

This application claims priority from Japanese Patent Application Nos. 2003-196347 filed on Jul. 14, 2003 and 2004-189911 filed on Jun. 28, 2004, which are hereby incorporated by reference.

BACKGROUND OF THE INVENTION

1. Field of the Invention

The present invention relates to a technique for improving lighting-up control for a laser.

2. Related Background Art

In a laser beam printer apparatus or the like for recording an image by an electrophotographic process, it is necessary to scan a photosensitive member with a laser beam to form an image. In particular, the stable rotating speed control for a rotary polygon mirror for deflecting a laser beam is important.

In general, in order to perform constant speed rotation control for a rotary polygon mirror driving motor, there is a method (PLL control method) for controlling a voltage applied to an IC for driving a rotary polygon mirror driving motor so that a phase difference between an oscillation frequency to become a reference, and an actually measured rotational frequency of the rotary polygon mirror driving motor between the magnetic poles, and the like); the fluctuation of the magnetic force of the magnet resulting from a change in temperature; and the like.

On the other hand, the other technique utilizes a sensor (BD sensor) provided inside an optical scanner for detecting a scanning timing for a light beam in order to control the writing position of an image. Since this BD sensor is not influenced by the fluctuation in magnetic force due to a magnet, the constant speed rotation control for the rotary polygon mirror driving motor can be carried out with high accuracy.

Such an apparatus for stably controlling a rotating speed is disclosed in Japanese Patent Application Laid-Open No. H09-183251.

However, in order to make a light beam incident to the BD sensor, it is necessary to forcibly light up a laser for emitting the light beam. Now, as for a timing at which the laser is forcibly lighted up in order to make the light beam incident to the BD sensor, the continuous light emission has to be started after a light beam used in scanning passes through an effective image area and before the light beam reaches a light receiving portion of the BD sensor. However, there is a problem that light reflected by a part of a writing optical system, refracted at a corner of an optical part, or reflected at a corner of a polygon mirror during forcible lighting-up, i.e., so-called flare light, reaches a photosensitive drum to write an unnecessary image. In addition, it is not preferable that a photosensitive member for image formation is needlessly exposed with a laser beam, and it is also not preferable that a laser is needlessly lighted up to shorten a laser lighting-up life. From a viewpoint of preventing these situations, it is desirable that a time period required to forcibly light up a laser to emit a light beam is as short as possible, and it is also desirable that a timing of starting to forcibly light up the laser to emit the light beam is as late as possible. Accordingly, various means for lighting up a laser in consideration of a timing of passing through a detection portion have been taken.

However, the laser is forcibly lighted up to emit the light beam every period during rotation of the polygon mirror, and this becomes a large factor for shortening a laser lighting-up life because a time zone for forcible lighting-up, if accumulated, always occupies about 5% of a time period during the rotation control as compared with the case of data of an image area to be drawn.

Thus, if the rotation of the polygon mirror is stopped during stand-by, then the lighting-up life can be saved to some degree. However, a reactivation time of the polygon mirror exerts an influence on delay of the next first print out time to delay the first print out time. In addition, if the beam detection timing is lost once, then it becomes necessary to expose an image area of a photosensitive member in order to find out the detection timing again. In particular, it is not preferable that such exposure is always carried out right before the start of the image formation. For these reasons, the means for stopping the rotation of the polygon mirror may not always be taken in some cases.

SUMMARY OF THE INVENTION

It is an object of the present invention to provide a light beam scanner which is capable of carrying out rotation control so as to avoid lighting-up of a laser every surface period of a rotary polygon to detect a light beam, thereby improving a life of the laser.

In order to attain the object described above, according to one aspect of the invention, a light beam scanner includes: a light beam generating portion; a beam detecting portion for detecting the light beam; a rotary polygon for deflecting and scanning the light beam; and a rotation controlling portion for controlling rotation of the rotary polygon on the basis of detection of the light beam by the beam detecting portion. The light beam scanner has: a first mode in which the light beam generating portion is turned ON to generate the light beam every surface period of the rotary polygon to detect the light beam; and a second mode in which the light beam generating portion is turned ON to generate the light beam with a long period specified with an integral multiple of 2 or more of the surface period of the rotary polygon to detect the light beam. In the light beam scanner, the rotation controlling portion, during non-formation of an image, controls the rotation of the rotary polygon so as to avoid the first mode.

Further, in order to attain the object described above, according to another aspect of the invention, a light beam scanner includes: a light beam generating portion; a beam detecting portion for detecting the light beam; a rotary polygon for deflecting and scanning the light beam; and a rotation controlling portion for controlling rotation of the rotary polygon on the basis of detection of the light beam by the beam detecting portion. The light beam scanner has: a first mode in which the light beam generating portion is turned ON to generate the light beam every surface period of the rotary polygon to detect the light beam; and a second mode in which the light beam generating portion is turned ON to generate the light beam with a long period specified with an integral multiple of 2 or more of the surface period of the rotary polygon to detect the light beam. In the light beam scanner, the rotation controlling portion, during formation of an image, controls the rotation of the rotary polygon in the first mode, and during non-formation of an image, controls the rotation of the rotary polygon in the second mode.

The above and other objects, features, and advantages of the invention will become more apparent from the following detailed description taken in conjunction with the accompanying drawings.

DESCRIPTION OF THE PREFERRED EMBODIMENTS

Figure 1:
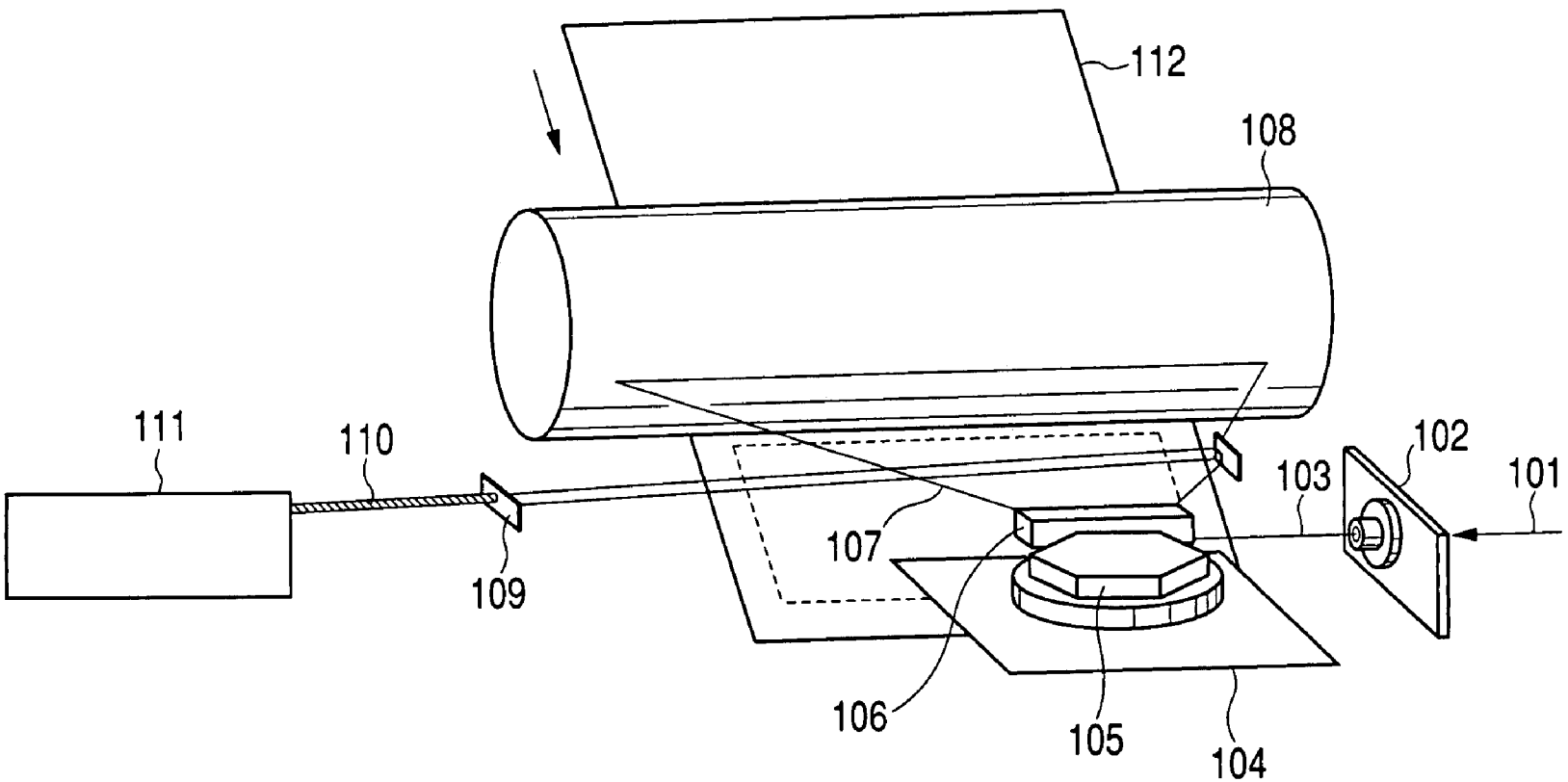
FIG. 1 is a schematic perspective view of an image forming portion in an image forming apparatus according to an embodiment of the present invention.

The present invention will now be described in detail below with reference to the accompanying drawings showing a preferred embodiment thereof. In the drawings, elements and parts, which are identical throughout the views, are designated by identical reference numeral, and duplicate description thereof is omitted.

FIG. 1 is a schematic perspective view explaining a construction of a main portion in an image forming apparatus (laser beam printer) according to an embodiment of the present invention.

An image signal (VDO signal) 101 is inputted to a laser unit 102 to be subjected to ON/OFF-modulation to thereby output a laser beam 103. A scanner motor 104 constantly rotates a rotary polygon mirror 105. A laser beam 107 deflected by the rotary polygon mirror 105 is focused on a photosensitive drum 108 as a surface to be scanned by an imaging lens 106. Thus, the surface of the photosensitive drum 108 is horizontally scanned with the laser beam 107 modulated with the image signal 101 (the scanning in a main scanning direction). In addition, the laser beam with which the surface of the photosensitive drum 108 has been horizontally scanned is applied to a photoelectric conversion element 109, which generates in turn a horizontal synchronous signal (hereinafter, referred to as "BD signal" for short). The BD signal is transmitted through a group line 110 to be guided to a control circuit 111. Here, a signal, which is obtained by frequency-dividing the BD signal by the number of surfaces of the polygon mirror 105, corresponds to a motor synchronous signal for the scanner motor 104. A latent image, which is formed on the photosensitive drum 108 with the modulated laser beam 107, is visualized in the form of a toner image by a developing device (not shown), and the toner image is then transferred onto a recording paper 112.

Figure 2:
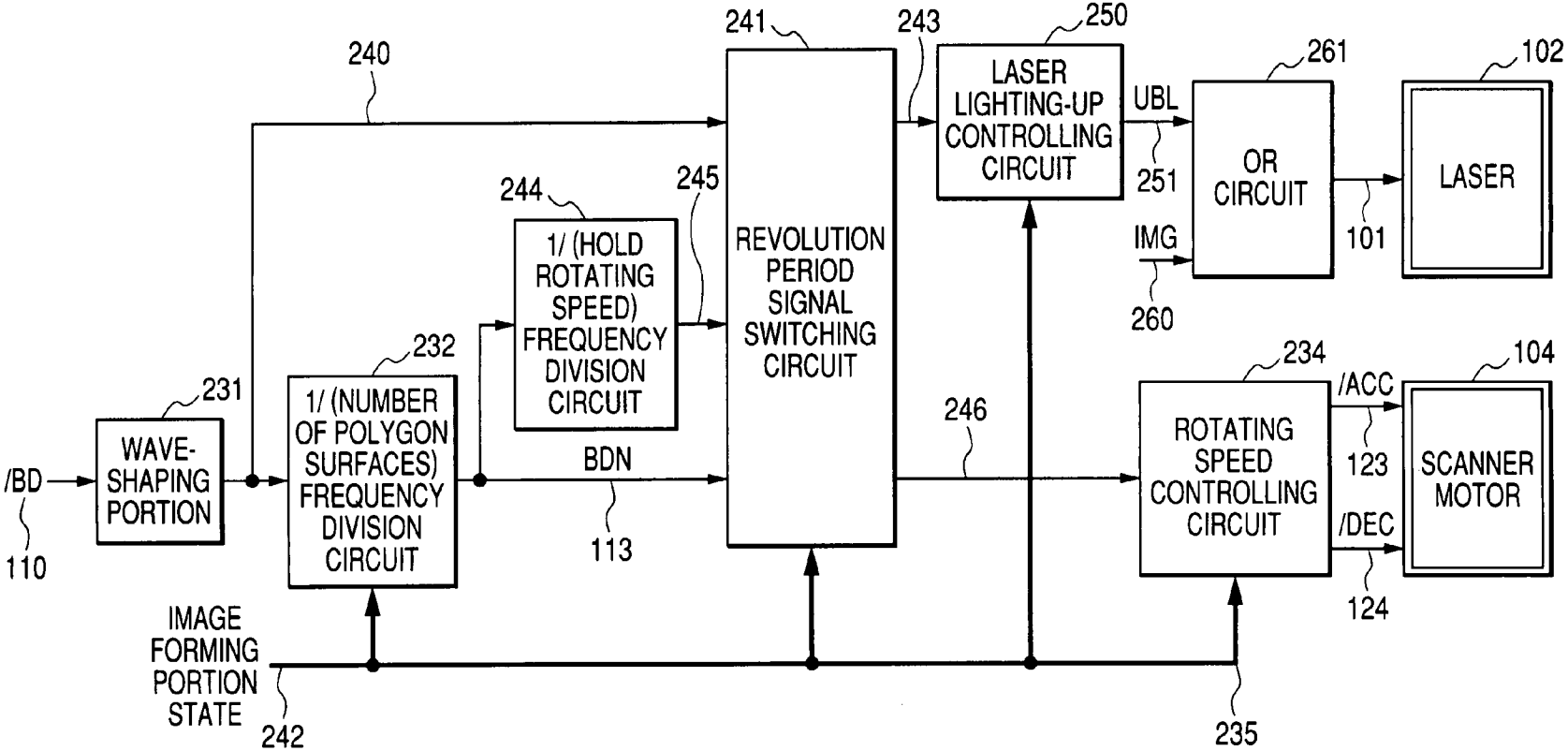
FIG. 2 is a block diagram explaining a control circuit of a scanner motor.

FIG. 2 is a block diagram explaining a control circuit for the scanner motor.

A power supply voltage (e.g., +24 V: not shown), a GND voltage (not shown), a /ACC signal 123 used to apply acceleration, and a /DEC signal 124 used to apply deceleration are inputted from a rotating speed controlling circuit 234 to the scanner motor 104. Here, a symbol "/" represents negative logic. Three commands, i.e., an acceleration command, a deceleration command and a speed holding command are transmitted in the form of the /ACC signal 123 and the /DEC signal 124. After a /BD signal 110 is shaped into a rectangular wave having a fixed length in a wave-shaping portion 231, the resultant signal is frequency-divided by the number of surfaces of the polygon mirror 105 in a 1/(number of polygon surfaces) frequency division circuit 232 to obtain a BDN signal 113. Then, the rotating speed controlling circuit 234 detects a rotating speed using the BDN signal 113 to automatically operate a next acceleration/deceleration command. Here, the rotating speed controlling circuit 234 frequency-divides the /BD signal 110 by the number of surfaces for one revolution of the polygon mirror 105 in the frequency division unit 232 because the BDN signal 113 is prevented from being influenced by the dispersion in surfaces of the polygon mirror. The control is carried out by referring constantly to the /BD signal 110 from a certain surface of the polygon mirror using the BDN signal 113.

A UBL signal 251 is a forcible lighting-up signal, for the laser 102, which is used to detect the /BD signal 110. After a lapse of a predetermined time period with the /BD signal 110 as a reference, a laser lighting-up controlling circuit 250 outputs the UBL signal 251, and after detecting the /BD signal 110, subsequently lights out the laser 102.

Figures 3, 4:
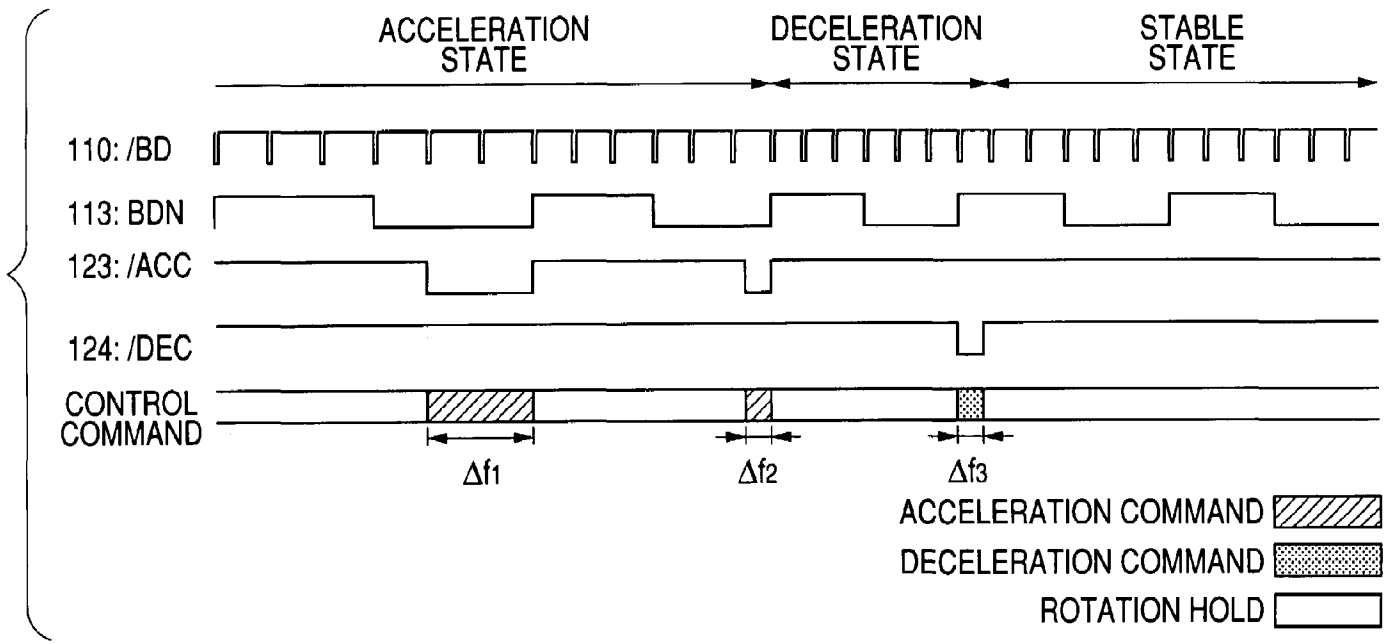
FIG. 3 is a diagram showing states of output signals of a rotating speed controlling unit.
FIG. 4 is a timing chart when the rotating speed controlling circuit is in operation.

FIG. 3 is a diagram showing states of speed control commands issued from the rotating speed controlling circuit 234, and FIG. 4 is a timing chart when the rotating speed controlling circuit 234 is in operation.

In a state until a rotating speed of the scanner motor 104 is increased up to a specified rotating speed, i.e., in an acceleration state, control commands, as in a time area of the acceleration state shown in FIG. 4, have two control commands, i.e., an acceleration command (/ACC=L (low level), and /DEC=H (high level)), and a rotation hold command (/ACC=/DEC=H). These command signals are generated from a target period count value and a comparison circuit. Then, the command signal is transmitted as the acceleration command to the scanner motor 104 in correspondence to only a time period by which a period of the BD signal 110 is longer than that in forming an image. That is to say, the acceleration command is more frequently issued as the rotating speed is lower, and the acceleration command is less frequently issued as the rotating speed approaches the specified rotating speed.

On the other hand, when the rotating speed of the scanner motor 104 is higher than that in forming an image, the control commands, as shown in a time area in the deceleration state of FIG. 4, have two control commands consisting of the deceleration command (/ACC=H, and /DEC=L) and the rotation hold command (/ACC=/DEC=H). A rate of the deceleration command occupied in the speed hold state is larger as the rotating speed is higher, and finally the state (rotating speed) changes into the speed hold state (the rotating speed in formation of an image).

In this speed hold state, the rotation is controlled in accordance with the rotation hold command (/ACC=/DEC=H). In actuality, in order to compensate for the minute acceleration/deceleration due to the noises, the driver dispersion or the like, the acceleration/deceleration command having about 1 to about several pulses is sparsely outputted to carry out the control so that the rotating speed is hardly changed. The foregoing is the description of the control circuit for generating the scanner motor control signals.

Figure 5:
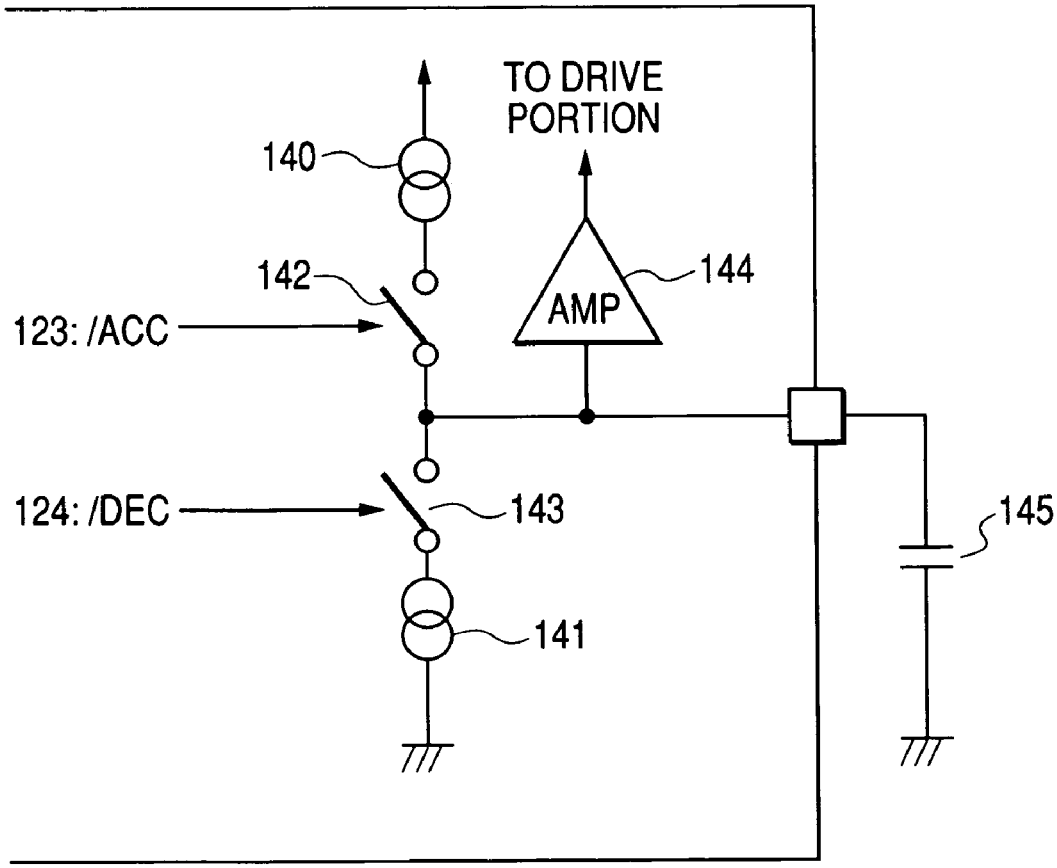
FIG. 5 is a schematic circuit diagram of an integration/driving circuit of the rotating speed controlling circuit.

FIG. 5 is a schematic circuit diagram showing a configuration of an integration circuit of a scanner motor driver IC provided inside the scanner motor 104.

The integration circuit includes constant current circuits 140 and 141, switching elements 142 and 143, a capacitor 145, and an amplifier 144. The constant current circuits 140 and 141, and the switching elements 142 and 143 constitute a charge and discharge circuit for the capacitor 145. Upon reception of an /ACC signal 123 at L in the switching element 142, the switching element 142 is turned ON to charge the capacitor 145 with a current from the constant current circuit 140. In addition, upon reception of a /DEC signal 124 at L in the switching element 143, the switching element 143 is turned ON to discharge a current set by the constant current circuit 141 from the capacitor 145. Consequently, a voltage developed across the capacitor 145 is increased or decreased in proportion to an ON-time of the /ACC signal 123 or the /DEC signal 124. This voltage is applied to a driving portion (not shown) through the amplifier 144 in the after stage. The driving portion supplies a current proportional to this voltage value to the scanner motor to rotate the scanner motor. When the rotating speed of the scanner motor is lower than the specified rotating speed, the voltage developed across the capacitor 145 is increased to accelerate the scanner motor. Conversely, when the rotating speed of the scanner motor is higher than the specified rotating speed, the voltage developed across the capacitor 145 is decreased to decelerate the scanner motor. Finally, the rotating speed of the scanner motor is stabilized at the target rotating speed.

Figure 6:
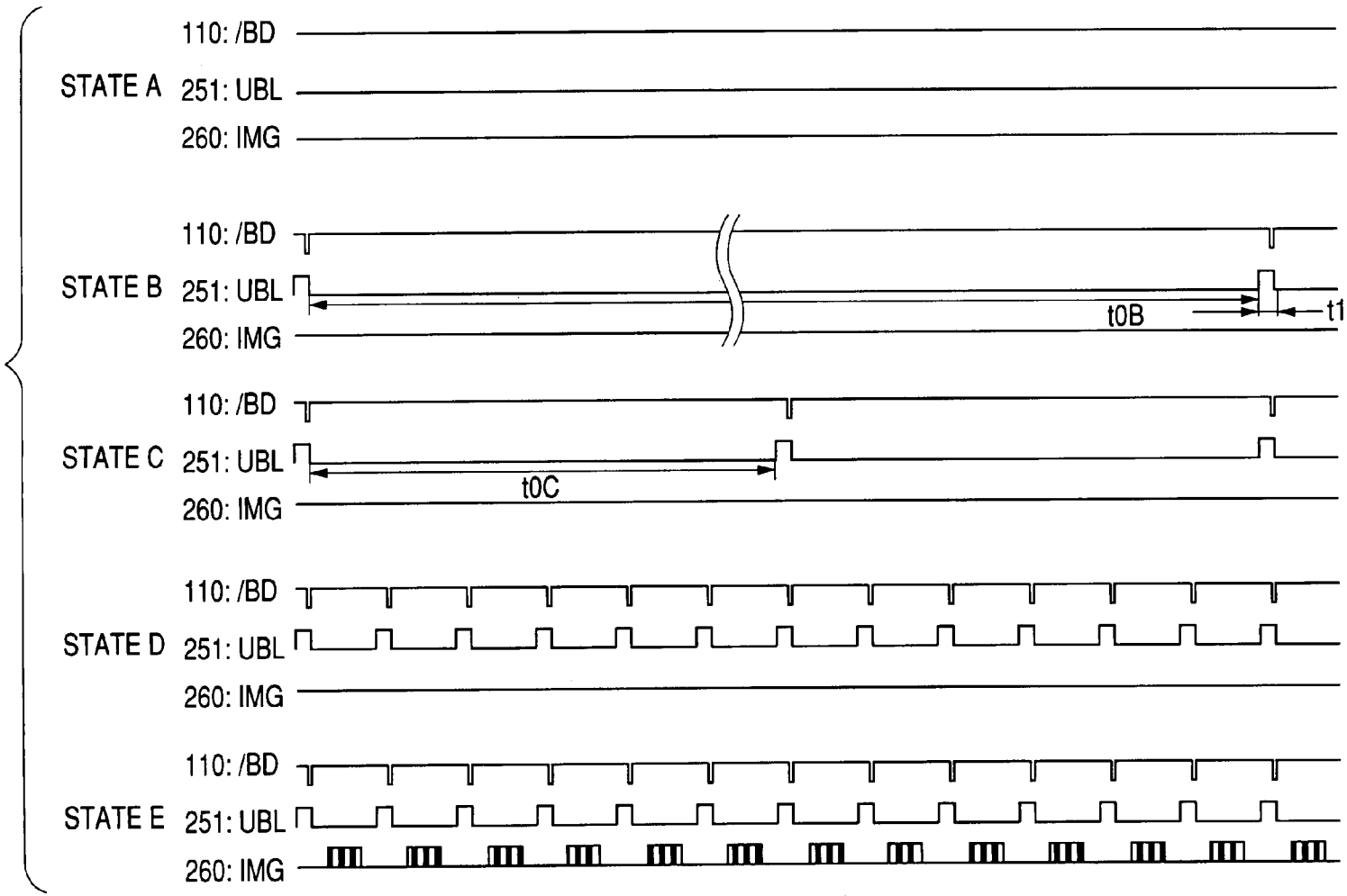
FIG. 6 is a timing chart explaining an operation of a laser control portion.

FIG. 6 shows a relationship between the lighting-up control for the laser and the rotation period detection signal /BD 110.

In FIG. 6, a UBL signal 251 represents a forcible lighting-up command for detection of the /BD signal 110. After a lapse of a predetermined time period of t0 with the /BD signal 110 detected last time as a reference, the forcible lighting-up command is issued to forcibly light up the laser, and after detection of the /BD signal 110, the laser is subsequently lighted out. The laser lighting-up controlling circuit 250 operates so as to switch an output state of the UBL signal shown in FIG. 6 over to another output state in accordance with an image forming portion state 242.

In FIG. 6, STATE A is a state during stop of the rotation.

STATE D is a state right before an image is drawn.

STATE E is a state when an image is being drawn.

Operations in the STATE D and STATE E will hereinafter be described.

The 1/(number of polygon surfaces) frequency division circuit 232 is controlled so as to carry out the frequency division, and a 1/(hold rotating speed) frequency division circuit 244 is controlled so as not to carry out the frequency division. The laser lighting-up controlling circuit 250 operates with an output 240 of the wave-shaping portion 231 as a reference, and the rotating speed controlling circuit 234 operates with the BDN signal 113 as a detection signal. A time period of (t0+t1) is set as a target period in the rotating speed controlling circuit 234. The forcible lighting-up command based on the UBL signal is issued after a lapse of a time period of t0 timed from the last detection of the BD signal. t1 is a lighting-up margin time period, and thus is a time period, which is provided for detection of the BD signal in advance in anticipation of the fluctuation in the BD period due to the rotation fluctuation of the polygon mirror and the dispersion in mirrors. The adjustment for stabilization of the amount of light of the laser of this apparatus is carried out while the UBL signal is in a valid state. Hence, that adjustment is carried out right before an image is drawn, whereby the rotating speed state and the laser light beam amount stabilization state equal to those when an image is being drawn are obtained.

An operation in STATE C will hereinafter be described.

The STATE C is a state when the rotation is stable and right before the stabilization thereof. At this time, the 1/(number of polygon surfaces) frequency division circuit 232 is controlled so as not to carry out the frequency division, and the 1/(hold rotating speed) frequency division circuit 244 is also controlled so as not to carry out the frequency division. The laser lighting-up controlling circuit 250 and the rotating speed controlling circuit 234 operate with the BDN signal 113 as a detection signal. A time period of (t0C+t1) is set as a target period in the rotating speed controlling circuit 234. The forcible lighting-up command based on the UBL signal is issued after a lapse of a time period of t0C timed from the last detection of the BD signal. t1 is a lighting-up margin time period, and thus is a time period, which is provided for detection of the BD signal in advance in anticipation of the fluctuation in the BD period due to the rotation fluctuation of the polygon mirror and the dispersion in mirrors. A timing at which the BD signal is detected corresponds to a surface, which is used as a reference by the rotation controlling portion.

An operation in STATE B will hereinafter be described.

The STATE B is a state when stand-by rotation is held. At this time the 1/(number of polygon surfaces) frequency division circuit 232 is controlled so as not to carry out the frequency division, and the 1/(hold rotating speed) frequency division circuit 244 is controlled so as to carry out the frequency division with a predetermined value. The laser lighting-up controlling circuit 250 and the rotating speed controlling circuit 234 operate with an output signal 245 of the 1/(hold rotating speed) frequency division circuit 244 as a detection signal. A time period of (t0B+t1) is set as a target period in the rotating speed controlling circuit 234. The forcible lighting-up command based on the UBL signal 251 is issued after a lapse of a time period of t0B timed from the last detection of the BD signal. t1 is a lighting-up margin time period, and thus is a time period, which is provided for detection of the BD signal in advance in anticipation of the fluctuation in the BD period due to the rotation fluctuation of the polygon mirror and the dispersion in mirrors. A timing at which the BD signal is detected corresponds to a surface, which is used as a reference by the rotation controlling portion.

A frequency division value obtained from the 1/(hold rotating speed) frequency division circuit 244 is determined depending on the rotational stability in the open control for the polygon mirror. The frequency division circuit 244 includes an integration circuit corresponding to the integration circuit of FIG. 5 as described above. Also, even when the rotation hold control is continued to be held, these systems can hold the rotating speed to some degree, including the inertia of the polygon mirror and the motor. A long period as the lowest limit necessary for detection of the rotation state is set on the basis of the above, whereby the reduction of the number of times of the forcible lighting-up of the laser specific to the present invention is attained as much as possible. That reduction is attained on condition that when the stand-by rotation is held, the rotation accuracy of the polygon motor is unnecessary, and for the purpose of shortening a first print out time, the rotation accuracy in stand-by can be recovered up to the rotation accuracy in drawing of an image as quickly as possible.

While in the above explanation, there has been described the specific example in which the control for the rotary polygon is carried out on the one revolution-basis, the present invention is not intended to be limited thereto. For example, the present invention can also be applied to other various cases where rotations corresponding to integral multiples of the number of surfaces of a polygon mirror are bases for the control. As a result, there is an effect that a time period required for the laser light emission when no image is drawn can be remarkably shortened by the means taken in the present invention. In addition, the control for the operation from stop of the rotary polygon to activation thereof has not been described, because it is not related to the substance of the present invention. Therefore, its details are omitted here. For example, the invention relating to activation, which has conventionally been proposed, may be included in the constitution of the present invention.

Heretofore, the laser is needlessly forcibly lighted up mainly in non-formation of an image such as in stand-by to shorten the life of the laser. However, as described above, according to this embodiment, it is possible to provide the laser printer in which the holding of stand-by rotation maintaining the first print out time is compatible with the lengthening of the life of the laser by effectively utilizing the control in the STATE B and STATE C.

The present invention is not limited to the apparatus of the above-mentioned embodiment, and hence may also be applied to a system constituted by a plurality of apparatuses and instruments, or an apparatus including one instrument. It is to be understood that the present invention is implemented even when a medium such as a storage medium, which stores therein a program code of a software for realizing the function of the above-mentioned embodiment is supplied to a system or an apparatus, and a computer (or a CPU or an MPU) of the system or the apparatus reads out the program code stored in the medium such as a storage medium to execute the program code.

In this case, the program code itself read out from the medium such as a storage medium realizes the function of the above-mentioned embodiment, and hence the medium such as a storage medium, which stores therein the program code constitutes the present invention.

As for the medium such as a storage medium, for supplying the program code, for example, there may be used a floppy (registered trademark) disc, a hard disc, an optical disc, a magneto-optical disc, a CD-ROM, a CD-R, a CD-RW, a DVD-ROM, a DVD-RAM, a DVD-RW, a DVD+RW, a magnetic tape, a nonvolatile memory card, a ROM, a download process made through a network, or the like.

In addition, it is to be understood that the present invention includes not only a case where the program code read out by the computer is executed to realize the function of the above-mentioned embodiment, but also a case where an OS or the like running on a computer executes a part of or all of an actual control processing in accordance with an instruction of the program code, and the function of the above-mentioned embodiment is realized through such a processing.

Moreover, it is to be understood that the present invention includes a case where after a program code read out from a medium such as a storage medium is written to a memory provided in a function expanding board inserted into a computer or a function expanding unit connected to a computer, a CPU or the like provided in the function expanded board or the function expanded unit executes a part of or all of an actual control processing in accordance with an instruction of the program code, and the function of the above-mentioned embodiment is realized through such a processing.

What is claimed is:

1. A light beam scanner comprising:

a light beam controller for controlling light emission of a light beam generating portion;

a rotary polygon for deflecting and scanning the light beam;

a beam detecting portion for detecting the light beam deflected by the rotary polygon; and a rotation controlling portion for controlling rotation of the rotary polygon on the basis of detection of the light beam by the beam detecting portion, wherein said light beam controller is constructed to control light emission in a selectable one of both of first and second modes;

wherein in the first mode the light beam generating portion is turned ON to generate the light beam every surface period of the rotary polygon to detect the light beam; and wherein in the second mode the light beam generating portion is turned ON to generate the light beam with a long period specified with an integral multiple of 2 or more of the surface period of the rotary polygon to detect the light beam, and wherein the rotation controlling portion, during non-formation of an image, controls the rotation of the rotary polygon in the second mode.

2. A light beam scanner according to claim 1, wherein the rotation controlling portion, during formation of an image, controls the rotation of the rotary polygon in the first mode.

3. A light beam scanner according to claim 2, wherein the integral multiple of the surface period of the rotary polygon corresponds to one revolution or more revolutions of the rotary polygon.

4. A light beam scanner according to claim 3, wherein during non-formation of an image, the light beam generating portion is held in a turn-OFF state for a time period corresponding to two or more revolutions of the rotary polygon.

5. A light beam scanner having comprising:

a light beam controller for controlling light emission of a light beam generating portion;

a rotary polygon for deflecting and scanning the light beam;

a beam detecting portion for detecting the light beam deflected by the rotary polygon; and a rotation controlling portion for controlling rotation of the rotary polygon on the basis of detection of the light beam by the beam detecting portion, wherein said light beam controller is constructed to control light emission in a selectable one of both of the first and second modes;

wherein in the first mode the light beam generating portion is turned ON to generate the light beam every surface period of the rotary polygon to detect the light beam;

wherein in the second mode the light beam generating portion is turned ON to generate the light beam with a long period specified with an integral multiple of 2 or more of the surface period of the rotary polygon to detect the light beam, and wherein the rotation controlling portion, during formation of an image, controls the rotation of the rotary polygon in the first mode, and during non-formation of an image, controls the rotation of the rotary polygon in the second mode.

6. A light beam scanner according to claim 5, wherein the integral multiple of the surface period of the rotary polygon corresponds to one revolution or more revolutions of the rotary polygon.

7. A light beam scanner according to claim 6, wherein during non-formation of an image, the light bean, generating portion is held in a turn-OFF state for a time period corresponding to two or more revolutions of the rotary polygon.

8. A light beam scanner according to claim 1, wherein the selectable one of the first and second modes is selected after the rotary polygon reaches a specified rotating speed.

9. A light beam scanner according to claim 5, wherein the selectable one of the first and second modes is selected after the rotary polygon reaches a specified rotating speed.

* * * * *